US006944919B2

(12) United States Patent
Wang

(10) Patent No.: US 6,944,919 B2
(45) Date of Patent: Sep. 20, 2005

(54) ZIPPER HEAD STRUCTURE

(76) Inventor: Lien Chou Wang, No. 273, San Chun St., Taipei Hsien (TW)

( * ) Notice: Subject to any disclaimer, the term of this patent is extended or adjusted under 35 U.S.C. 154(b) by 125 days.

(21) Appl. No.: 10/627,706

(22) Filed: Jul. 28, 2003

(65) Prior Publication Data

US 2005/0022346 A1 Feb. 3, 2005

(51) Int. Cl.[7] ..... A44B 19/26
(52) U.S. Cl. ..... 24/429
(58) Field of Search ..... 24/429–432, 386; 70/68; 403/133

(56) References Cited

U.S. PATENT DOCUMENTS

| | | | | | |
|---|---|---|---|---|---|
| 1,962,479 | A | * | 6/1934 | Carlile | 24/429 |
| 2,019,220 | A | * | 10/1935 | Gammons | 24/419 |
| 2,302,741 | A | * | 11/1942 | Carlile | 29/441.1 |
| 2,607,976 | A | * | 8/1952 | Zahel | 24/416 |
| 3,011,238 | A | * | 12/1961 | McNamara | 24/427 |
| 3,343,235 | A | * | 9/1967 | Morin | 24/429 |
| 3,583,044 | A | * | 6/1971 | Howell | 24/431 |
| 3,641,634 | A | * | 2/1972 | Asai | 24/429 |
| 3,718,949 | A | * | 3/1973 | Harlam et al. | 24/429 |
| 4,123,829 | A | * | 11/1978 | Takabatake | 24/386 |
| 5,067,209 | A | * | 11/1991 | Terada et al. | 24/429 |
| 5,353,480 | A | * | 10/1994 | Keyaki et al. | 24/429 |
| 5,535,491 | A | * | 7/1996 | Allport | 24/429 |
| 5,562,357 | A | * | 10/1996 | Sandell | 403/122 |
| 5,653,548 | A | * | 8/1997 | Amdahl | 403/133 |

FOREIGN PATENT DOCUMENTS

| | | | | | |
|---|---|---|---|---|---|
| EP | 1095583 | A1 | * | 5/2001 | A44B/19/26 |
| JP | 10014616 | A | * | 1/1998 | A44B/19/26 |
| JP | 2002017410 | A | * | 1/2002 | A44B/19/26 |
| JP | 2002209612 | A | * | 7/2002 | A44B/19/26 |
| WO | WO 9737558 | A1 | * | 10/1997 | A44B/19/26 |

* cited by examiner

*Primary Examiner*—James R. Brittain
(74) *Attorney, Agent, or Firm*—Rosenberg, Klein & Lee

(57) ABSTRACT

A zipper head structure comprises a pull tab, a base and a universal joint. The base has a receiving space for receiving a zipper chain scoop. The universal joint is connected between the pull tab and the base. Through the design of the universal joint, the pull tab can rotate for 360 degrees to match the motion of the zipper, hence providing the most appropriate and labor-saving angle.

12 Claims, 9 Drawing Sheets

ZIPPER HEAD STRUCTURE

FIELD OF THE INVENTION

The present invention relates to a zipper head structure and, more particularly, to a zipper head whose pull tab can rotate for 360 degrees and achieve a large torque.

BACKGROUND OF THE INVENTION

As shown in FIG. 1, a conventional zipper head comprises a pull tag 1A and a base 4A. A pivotal portion 11A is disposed at one end of the pull tag 1A. A pivotal groove 42A is disposed at the upper half of the base 4A. The pivotal portion 1A of the pull tag 1A is pivotally placed in the pivotal groove 42A of the base 4A for connecting the pull tag 1A and the base 4A.

However, the pull tag 1A of the above conventional zipper head can only be dully pulled forwards and backwards. In order that the pull tag 1A can be easily pulled forwards and backwards, the connection between the pull tag 1A and the base 4A cannot be too tight in design. Therefore, the bearable torque thereof is relatively limited.

Accordingly, the above conventional zipper head has inconvenience and drawbacks in practical use. The present invention aims to solve the problems in the prior art.

SUMMARY OF THE INVENTION

The primary object of the present invention is to provide a zipper head structure to improve the conventional zipper head whose pull tag can only be pulled forwards and backwards or leftwards and rightwards, and swings loosely. The pull tag of the zipper head of the present invention can rotate for 360 degrees in a slipshod way to match the motion of a zipper for providing the most appropriate and labor-saving angle. Moreover, a uniform effort point and a large effort area are accomplished, hence providing a convenient, labor-saving zipper head structure with a large torque.

To achieve the above object, the present invention provides a zipper head structure, which comprises a pull tag, a base, and a universal joint. The base has a receiving space for receiving a zipper chain scoop. The universal joint is connected between the pull tab and the base to let the pull tag be capable of rotating for 360 degrees.

The various objects and advantages of the present invention will be more readily understood from the following detailed description when read in conjunction with the appended drawing, in which:

DETAILED DESCRIPTION OF THE PREFERRED EMBODIMENTS

Figure 1:
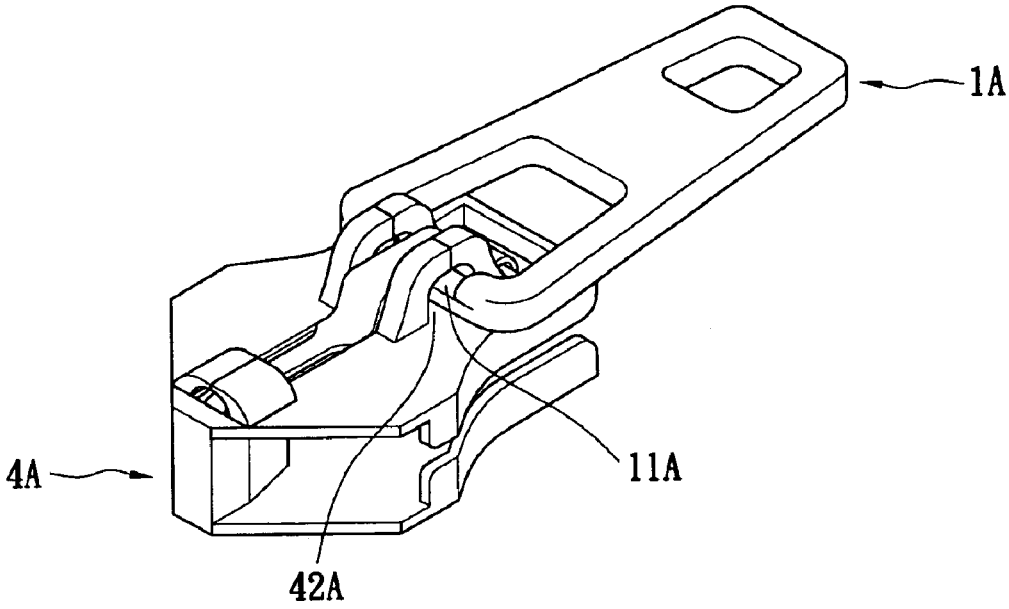
FIG. 1 PRIOR ART
FIG. 1 is a perspective view of a conventional zipper head.
Figure 2:
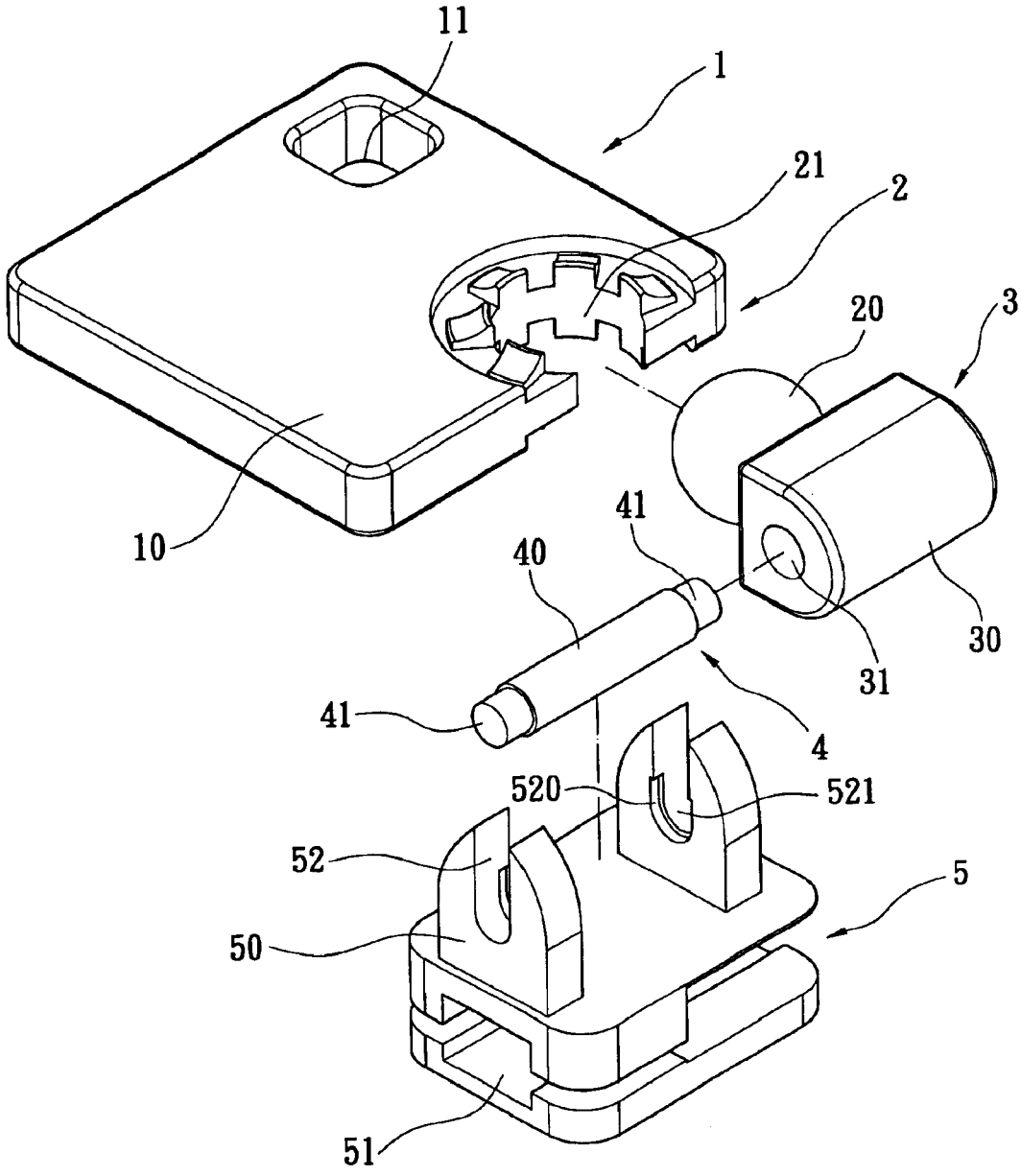
FIG. 2 is an exploded perspective view of a first embodiment of the present invention.
Figure 3:
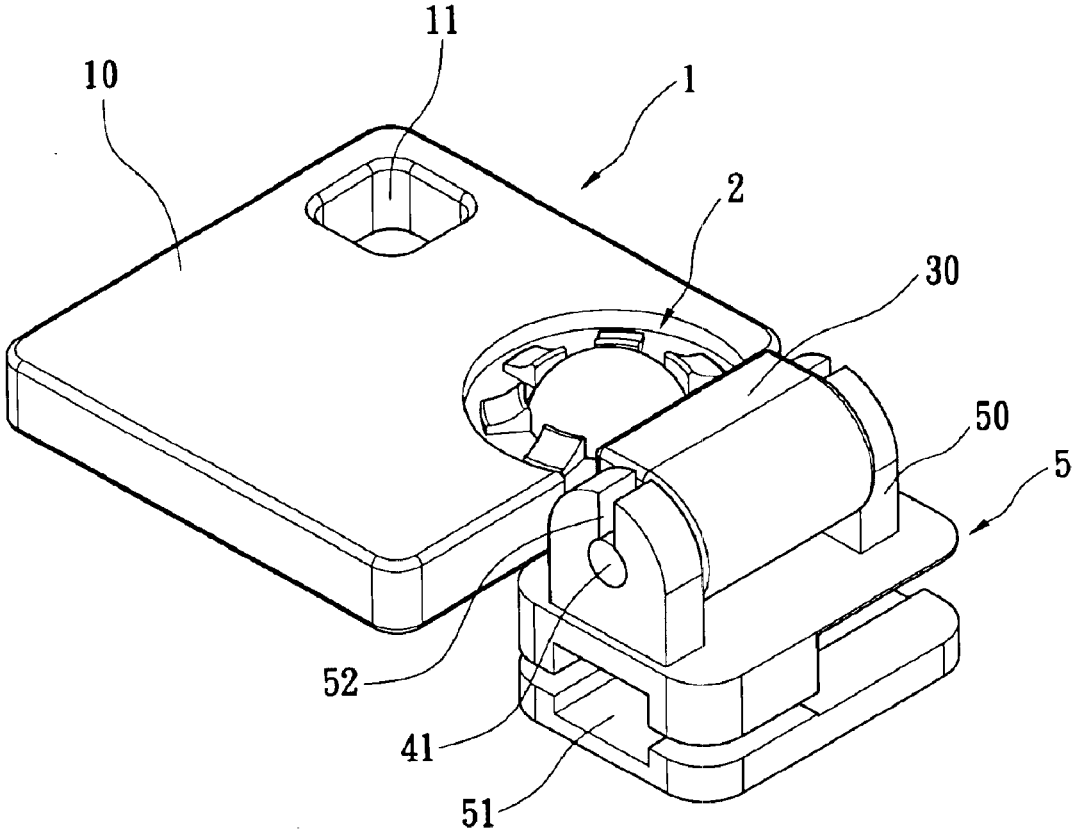
FIG. 3 is a perspective view of the first embodiment of the present invention.

As shown in FIGS. 2 and 3, the present invention provides a zipper head structure comprising a pull tag 1, a universal joint 2, an axis 3, a central pin 4 and a base 5. The pull tag 1 has a plank 10 with a small hole 11 formed at an edge or corner thereof for convenient hanging of a decoration or a nameplate on the pull tag 1. The plank 10 can be square, rectangular or circular. The shape of the plank 10 is not limited, and can vary according to necessity.

The universal joint 2 comprises a ball body 20 and an arc tooth base 21. The arc tooth base 21 is arranged at an edge of the pull tag 1. The arc tooth base is one larger than a semicircle.

The axis 3 has a cylinder 30. The ball body 20 is integrally arranged outside the cylinder 30 of the axis 3. The arc tooth base 21 is engaged with the ball body 20 to tightly connect the pull tag 1 and the axis 3. The ball body 20 is rotatably arranged in the arc tooth base 21. The universal joint 2 can let the pull tag 1 can freely rotate for 360 degrees. The cylinder 30 has a circular hole 31 therein. The central pin 4 passes through the circular hole 31 and is fixed onto the base 5.

The central pin 4 is cylindrical, and has a bar 40 and two bar heads 41. The two bar heads 41 are integrally connected at two ends of the bar 40. The bar heads 41 are thinner than the bar 40.

The base 5 has two holders 50 and a receiving space 51, which are integrally formed. The two holders 50 are arranged at the upper half of the base 5. Each of the holders 50 has a U-shaped opening 52, whose inner side opening 520 is larger than whose outer side opening 521. The central pin 4 passes through the circular hole 31, is bolted with the axis 3, and is then arranged on the U-shaped openings 52. The two bar heads 41 of the central pin 4 exactly coincide with the outer side opening 521. Two ends of the bar 40 exactly coincide with the inner side opening 520. The two U-shaped openings 52 are pressed close with machine to let the central pin 4 be firmly fastened therein. The axis 3, the central pin 4 and the base 5 can thus be tightly connected together. The receiving space 51 is disposed at the lower half of the base 5. The receiving space 51 has a zipper chain scoop (not shown) disposed therein for opening or closing the engagement of the zipper chain scoop.

Figure 4:
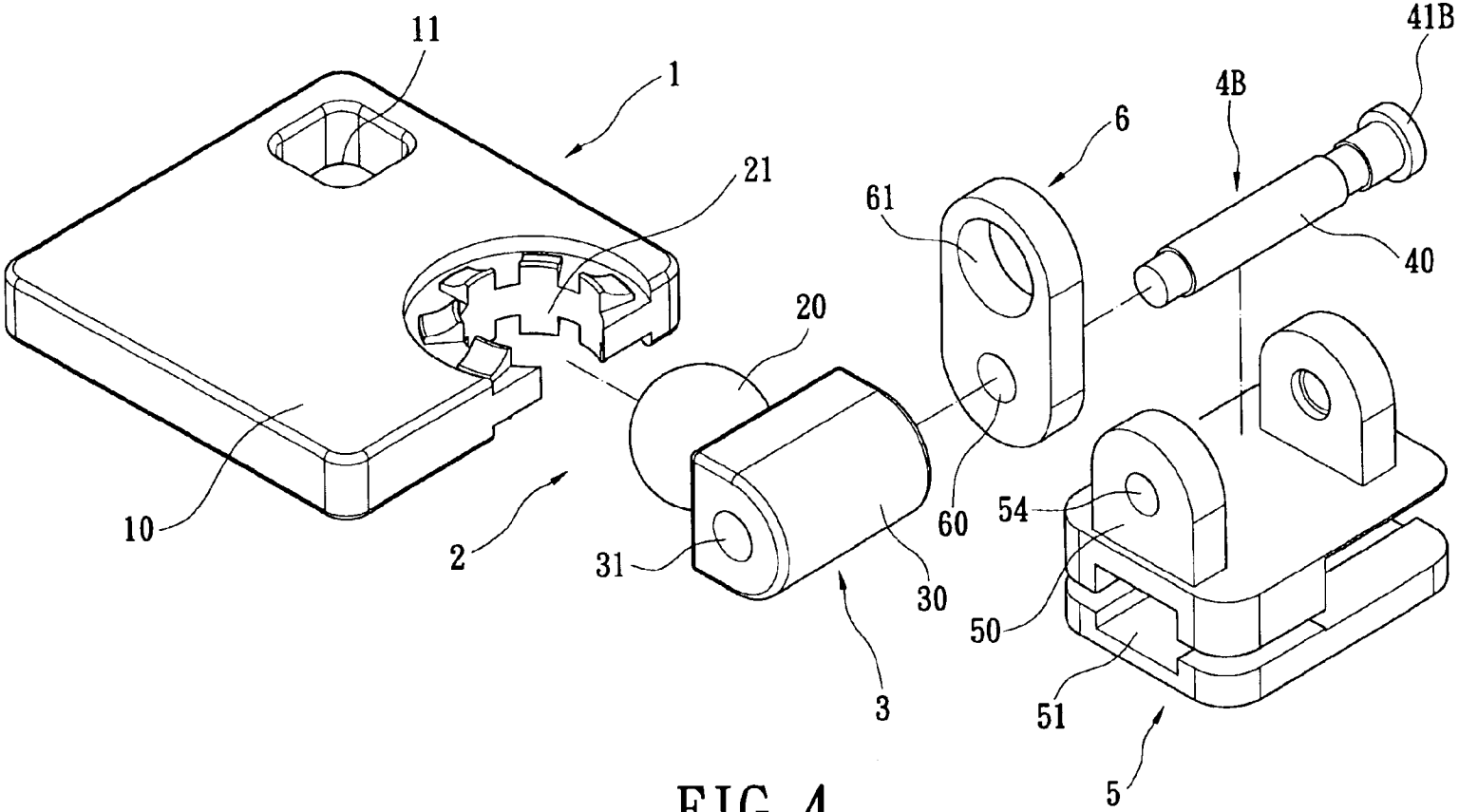
FIG. 4 is an exploded perspective view of a second embodiment of the present invention.

As shown in FIG. 4, each of the holders 50 on the base 5 has a small hole 54, and a plate 6 is disposed outside one of the small holes 54. The plate 6 has a hole 60 and a padlock hole 61. A central pin 4B of another shape is also designed. One end of the central pin 4B is a bar head 41B thicker than the bar 40. The central pin 4B passes through the hole 60 and the circular hole 31. The bar head 41B is fixed outside the plate 6, and is bolted in the two small holes on the base 5 to be conveniently fixed on the base 5. The plate 6 can thus pivotally arranged at one end of the cylinder 30. The padlock hole 61 can align with a padlock hole 61 of another zipper head. A lock passes through the two padlock holes 61 to fix the two zipper heads, hence preventing the zipper of a baggage case or suitcase from being opened by other people and thus ensuring the secrecy and safety of the baggage case or suitcase.

Figure 5:
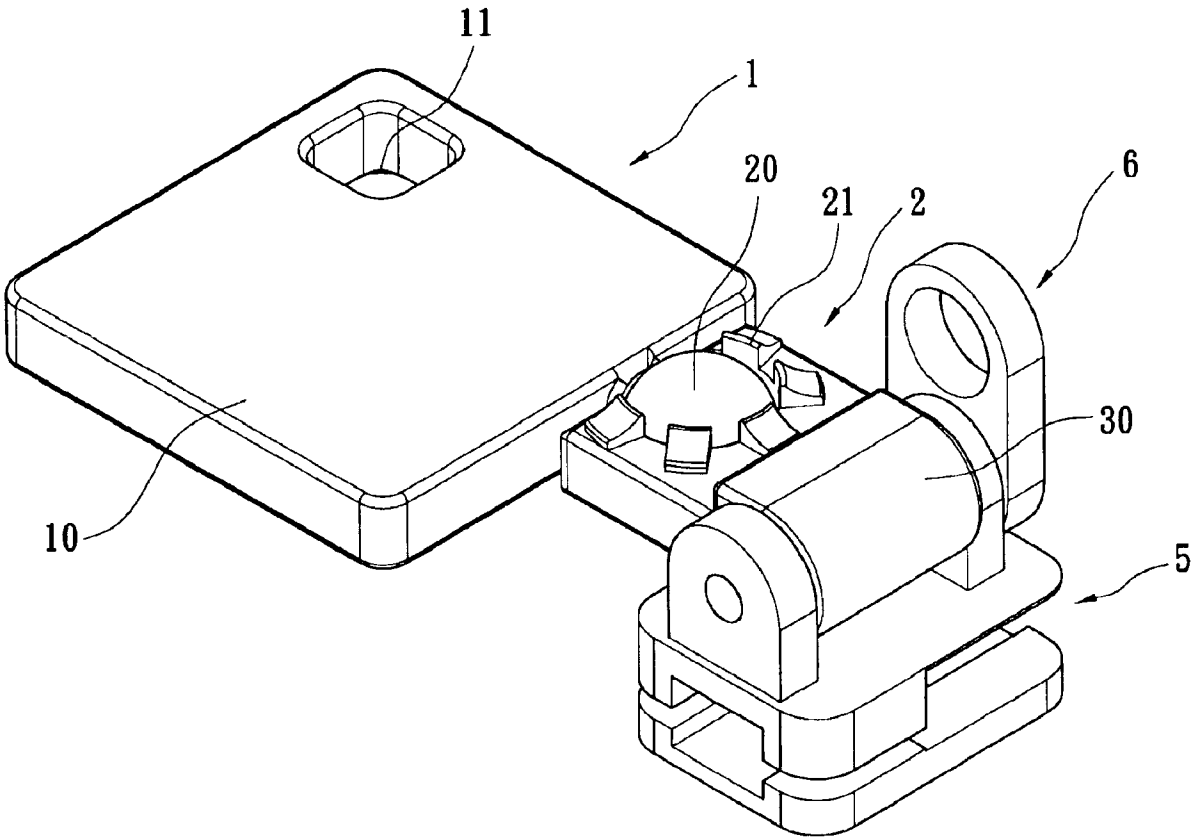
FIG. 5 is a perspective view of a third embodiment of the present invention.

As shown in FIG. 5, the ball body 20 of the universal joint 2 is disposed at an edge of the pull tag 1. The arc tooth base 21 is disposed outside the axis 3. The arc tooth base 21 is engaged with the ball body 20 to tightly connect the pull tag 1 and the axis 3 together.

Figure 6:
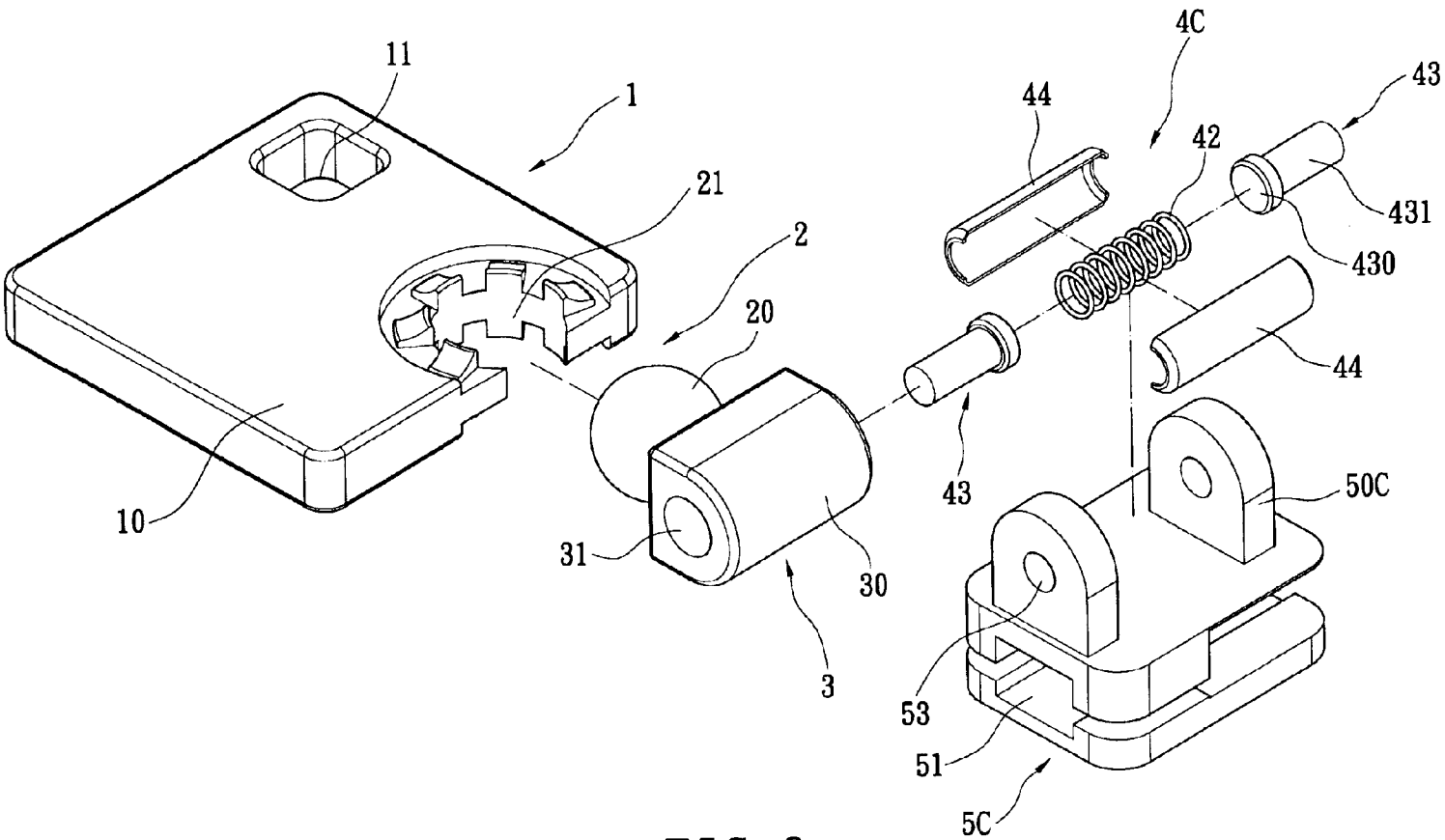
FIG. 6 is an exploded perspective view of a fourth embodiment of the present invention.

As shown in FIG. 6, a central pin 4C and a base 5C of another type are designed. Each of two holders 50C on the base 5C has a small hole 53. The central pin 4C has an elastic component 41, two movable pole 43 and two cover bodies 44. The movable pole 43 is composed of a pole head 430 and a pole shank 431. The cover bodies 44 are two semicircular shells with two slightly smaller ends. The elastic component 42 is a spring. Two ends of the elastic component 42 are clamped by the pole heads 430 of the two movable poles 43 and placed inside the cover bodies 44. The two cover bodies 44 are tightly locked together to form the cylindrical central pin 4C. Because the elastic component 42 is placed inside the cover bodies 44 and pressed by the pole heads 430, the central pin 4C has elasticity and can press upon tail ends of the two pole shanks 431 to be easily bolted in the two small hole 53 on the base 5C and conveniently fixed on the base 5C.

Figure 7:
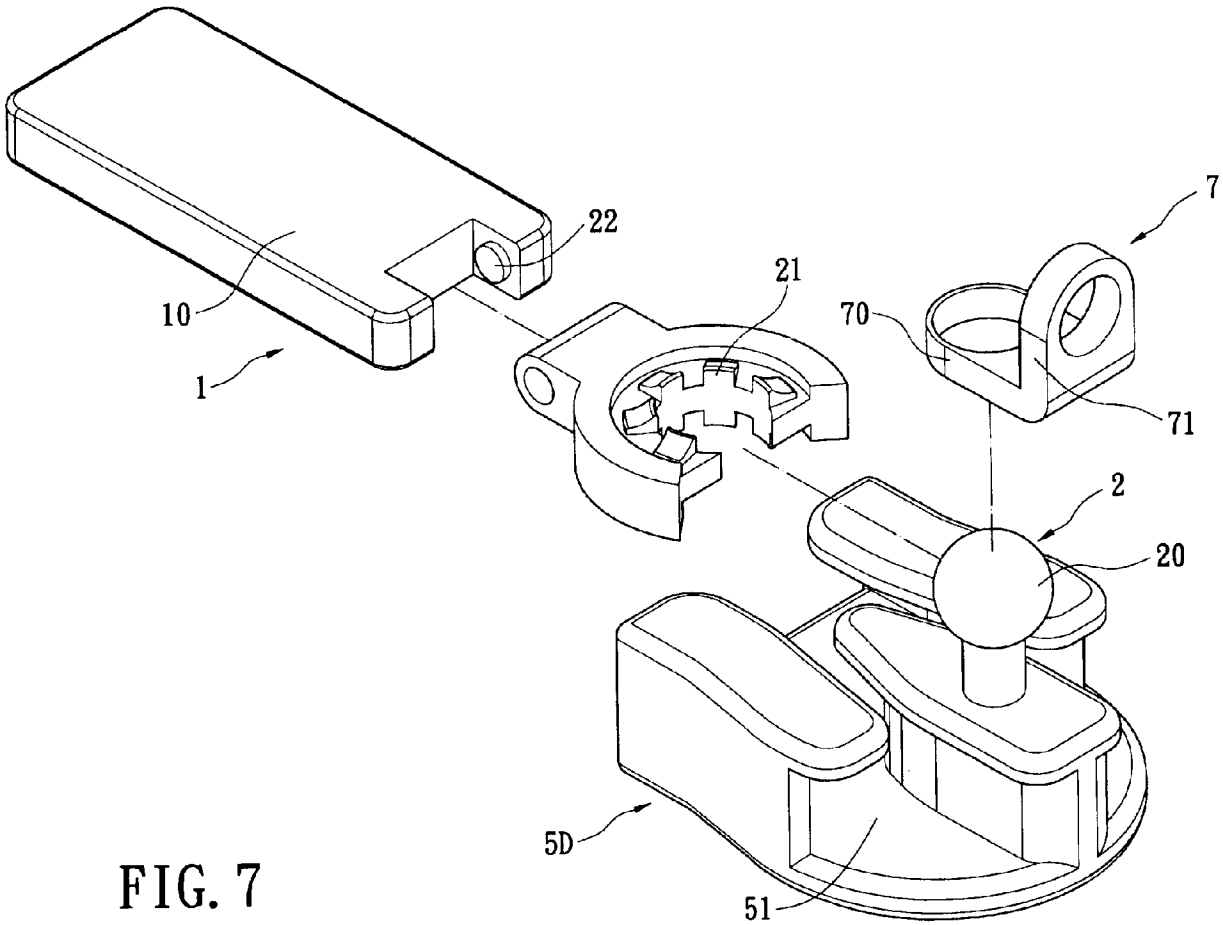
FIG. 7 is an exploded perspective view of a fifth embodiment of the present invention.
Figure 8:
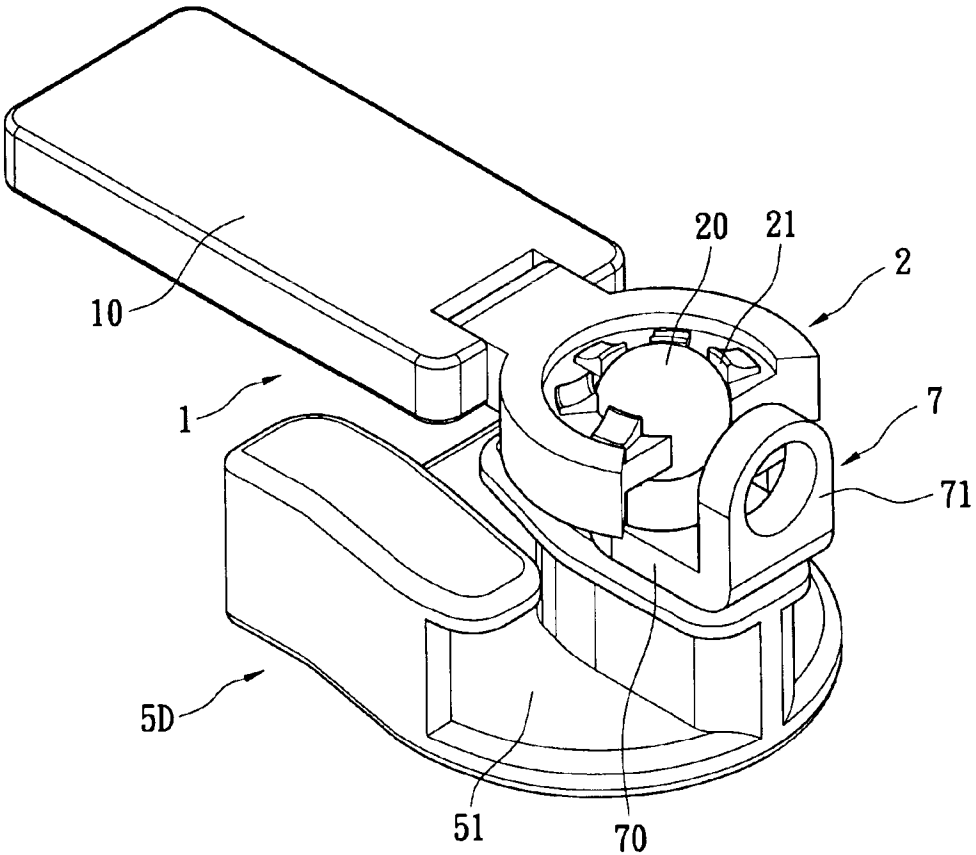
FIG. 8 is a perspective view of the fifth embodiment of the present invention.

As shown in FIGS. 7 and 8, a base 5D of another type is designed. The base 5D applies to concealed zippers. The ball body 20 of the universal joint 2 is integrally formed at the top of the base 5D by means of die casting. The arc tooth base 21 of the universal joint 2 is pivotally connected with the pull tag 1 via a pivot 22. The arc tooth base 21 can also be movably and pivotally connected with the pull tag 1 in a clipping or another way to let the direction of the pull tag 1 be not limited. The arc tooth base 21 is engaged with the ball body 20 to tightly connect the pull tag 1 and the base 5D and also let the pull tag 1 be capable of freely rotating for 360 degrees.

An L-shaped ring 7 is also provided. The L-shaped ring 7 has a first ring 70 and a second ring 71. The two rings 70 and 71 are circular. The first ring 70 is telescoped on the ball body 20 so that the L-shaped ring 7 can be pivotally arranged on the base 5D. The second ring 71 can be used as a padlock hole to facilitate fixing two zipper heads with a lock. If a padlock is not required, it is not necessary to provide the L-shaped ring 7.

Figure 9:
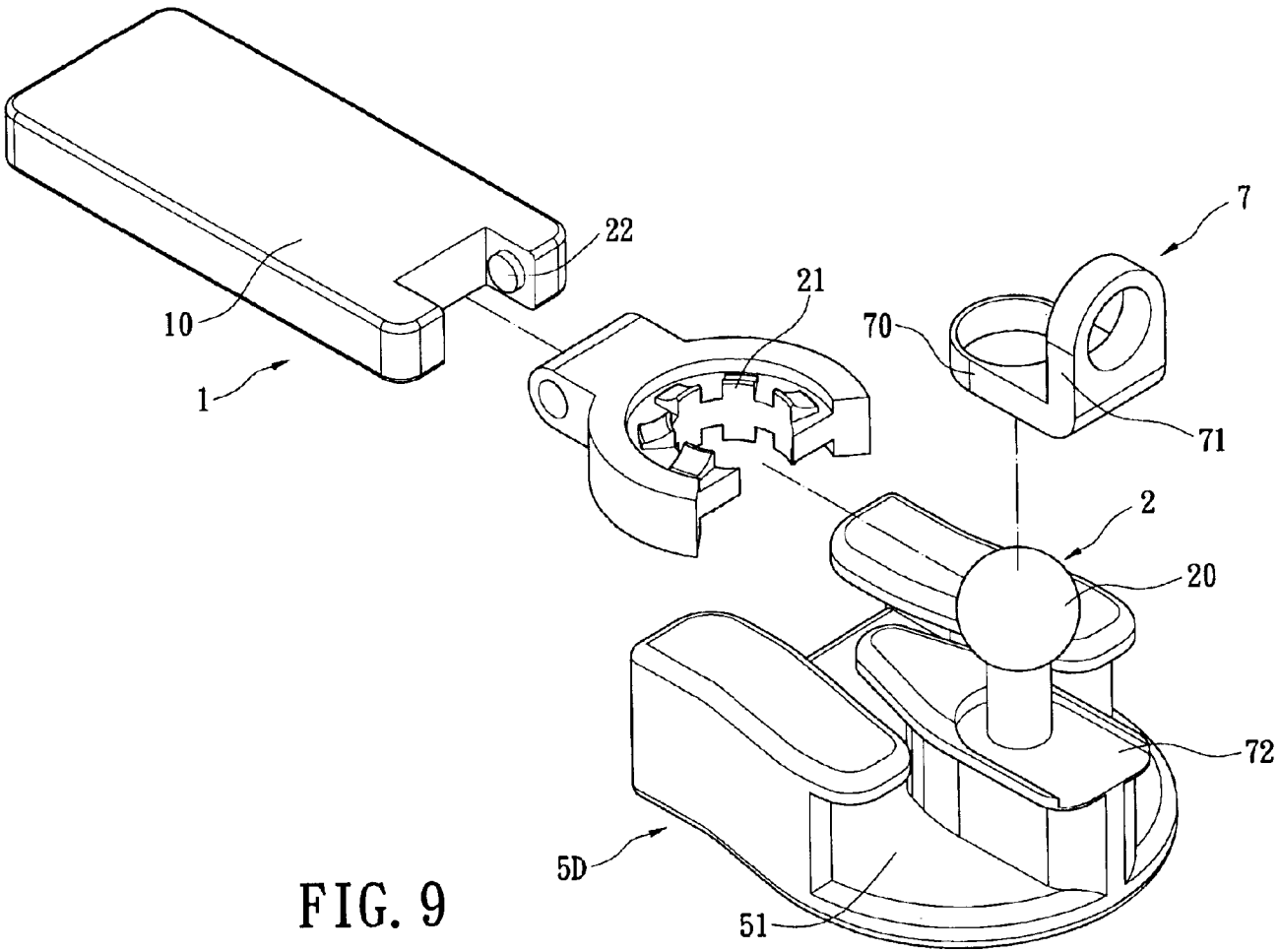
FIG. 9 is an exploded perspective view of a sixth embodiment of the present invention.

As shown in FIG. 9, a recessed portion 72 can also be formed on the base 5D. The recessed portion 72 can be used for placement of the L-shaped ring 7 to let the height of the L-shaped ring 7 protruding out of the top of the base 5D be smaller.

To sum up, the present invention improves the conventional zipper head whose pull tag can only be pulled forwards and backwards or leftwards and rightwards or swings loosely. The pull tag 1 of the zipper head of the present invention can rotate for 360 degrees in a slipshod way to match the motion of a zipper for providing the most appropriate and labor-saving angle. Moreover, the pull tag 1 tightly connects the axis 3 and the base 5 or 5C with a uniform effort point and a large effort area so as to provide a convenient, labor-saving zipper head structure with a large torque. Moreover, the plate 6 (or the L-shaped ring 7) is provided so that a lock can pass through the two padlock holes 61 to fix two zipper heads, hence preventing the zipper of a baggage case or suitcase from being opened by other people and thus ensuring the secrecy and safety of the baggage case or suitcase.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A zipper head structure comprising:

a pull tag;

a base having a receiving space formed at a lower half thereof for receiving a zipper chain scoop and two holders formed at an upper half of said base;

a universal joint connected between said pull tag and said base to allow said pull tag be capable of freely rotating through 360 degrees;

an axis having a circular hole therein, said universal joint being used to connect said pull tag and said axis; and a central pin being bolted in said circular hole of said axis and arranged on said two holders.

2. The zipper head structure as claimed in claim 1, wherein said pull tag is a plank, and said plate has a small hole for hanging a decoration or a nameplate therefrom.

3. The zipper head structure as claimed in claim 1, wherein said universal joint comprises an arc tooth base and a ball body, said arc tooth base is arranged at an edge of said pull tag, said ball body is arranged outside said axis, and said arc tooth base is engaged with said ball body to tightly connect said pull tag and said axis together.

4. The zipper head structure as claimed in claim 1, wherein said universal joint comprises an arc tooth base and a ball body, said arc tooth base is arranged outside said axis, said ball body is arranged at an edge of said pull tag, and said arc tooth base is engaged with said ball body to tightly connect said pull tag and said axis together.

5. The zipper head structure as claimed in claim 1, wherein each of said holders has a U-shaped opening whose inner side opening is larger than whose outer side opening, said central pin is bolted with said axis to be arranged on said U-shaped openings, said central pin has a bar and two bar heads, said bar heads of said central pin exactly coincide with said outer side opening, two ends of said bar exactly coincide with said inner side opening, and said U-shaped openings are pressed close to firmly fasten said central pin in said U-shaped openings.

6. The zipper head structure as claimed in claim 1, wherein each of said holders has a small hole, a plate is disposed outside one of said small holes, said plate has a hole and a padlock hole, said central pin has a bar and two bar heads, one of said bar heads of said central pin is thicker than said bar, said central pin passes through said hole and said circular hole of said axis, and said two bar heads are fixed outside said plate to firmly fasten said central pin in said small hole.

7. The zipper head structure as claimed in claim 1, wherein a small hole is formed on each of said holders, said central pin has an elastic component, two movable poles and two cover bodies, each of said movable poles is composed of a pole head and a pole shank, two ends of said elastic component are clamped by said pole heads of said movable poles and placed inside said cover bodies, said two cover bodies are tightly locked together to form said central pin, and said central pin has elasticity and can press upon tail ends of said two pole shanks to be bolted in said small holes of said two holders and fixed on said base.

8. A zipper head structure comprising:

a pull tag;

a base having formed therein a receiving space for receiving a zipper chain scoop;

a universal joint connected between said pull tag and said base to allow said pull tag be capable of freely rotating through 360 degrees;

wherein said universal joint comprises an arc tooth base and a ball body, said ball body is arranged at a top of said base, said arc tooth base is pivotally connected with said pull tag, and said arc tooth base is engaged with said ball body to tightly connect said pull tag and said base together.

9. The zipper head structure as claimed in claim 8, wherein said arc tooth base is pivotally connected with said pull tag with a pivot.

10. The zipper head structure as claimed in claim 8, further comprising an L-shaped ring, said L-shaped ring has a first ring and a second ring, said first ring is telescoped on said ball body to let said L-shaped ring be pivotally arranged on said base, and said second ring can be used as a padlock hole.

11. The zipper head structure as claimed in claim 10, wherein a recessed portion is formed on said base, and said L-shaped ring is placed on said recessed portion.

12. The zipper head structure as claimed in claim 8, wherein said base applies to concealed zippers.

* * * * *